US008897476B2

(12) United States Patent
Fujisawa et al.

(10) Patent No.: US 8,897,476 B2
(45) Date of Patent: Nov. 25, 2014

(54) SPEAKER APPARATUS

(71) Applicant: Sony Corporation, Tokyo (JP)

(72) Inventors: Keiichi Fujisawa, Kanagawa (JP); Arinobu Ueda, Singapore (SG)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 13/728,519

(22) Filed: Dec. 27, 2012

(65) Prior Publication Data

US 2013/0177197 A1 Jul. 11, 2013

(30) Foreign Application Priority Data

Jan. 6, 2012 (JP) ..... 2012-001168

(51) Int. Cl.
*H04R 1/02* (2006.01)
*H04R 5/02* (2006.01)
*H04R 9/08* (2006.01)

(52) U.S. Cl.
CPC .. *H04R 1/02* (2013.01); *H04R 5/02* (2013.01); *H04R 2205/021* (2013.01)
USPC ..... 381/334; 381/369

(58) Field of Classification Search
USPC ..... 381/394, 389, 386, 388, 333, 306, 345
See application file for complete search history.

(56) References Cited

U.S. PATENT DOCUMENTS

2006/0280045 A1* 12/2006 Ritsher et al. ..... 369/30.01
2013/0039521 A1* 2/2013 Zhou et al. ..... 381/333

FOREIGN PATENT DOCUMENTS

| | | | |
|---|---|---|---|
| JP | 11055377 | A | 2/1999 |
| JP | 2002185597 | A | 6/2002 |
| JP | 2003061178 | A | 2/2003 |
| JP | 2004313449 | A | 11/2004 |
| JP | 2005184050 | A | 7/2005 |
| JP | 2007143256 | A | 6/2007 |
| JP | 2009051493 | A | 3/2009 |
| JP | 2010056969 | A | 3/2010 |

* cited by examiner

*Primary Examiner* — Curtis Kuntz
*Assistant Examiner* — Sunita Joshi
(74) *Attorney, Agent, or Firm* — Sony Corporation of America

(57) ABSTRACT

Disclosed herein is a speaker apparatus, including: a housing having a speaker disposition section in which a speaker unit is disposed, and an apparatus receiving section which receives a portable terminal apparatus mounted thereon. The speaker apparatus further includes a connector provided on the apparatus receiving section such that a connector section of the portable terminal apparatus is to be connected to the connector; a holder provided on the apparatus receiving section and supported for pivotal motion on the housing in such a manner as to be pivoted, in a state in which the portable terminal apparatus is connected to the connector, in a first direction to press down the portable terminal apparatus from the opposite side to the connector to hold the portable terminal apparatus; and a biasing spring provided on the apparatus receiving section and configured to bias the holder in the first direction.

11 Claims, 15 Drawing Sheets

SPEAKER APPARATUS

CROSS-REFERENCE TO RELATED APPLICATION

The present application claims priority from Japanese Patent Application No. JP 2012-001168 filed in the Japanese Patent Office on Jan. 6, 2012, the entire content of which is incorporated herein by reference.

BACKGROUND

The present technology relates to a technical field of speaker apparatus. More particularly, the present technology relates to a technical field wherein a portable terminal apparatus connected to a connector is pressed down by a holder from the opposite side to the connector to hold the portable terminal apparatus in a stable state.

A speaker apparatus on which a portable terminal apparatus such as a digital music player (DMP) or a portable telephone set is mounted is known and disclosed, for example, in JP-T-2008-546126 (hereinafter referred to as Patent Document 1).

In such a speaker apparatus as just described, an apparatus mounting section at which a portable terminal apparatus is to be mounted is provided. In a state in which a portable terminal apparatus is mounted at the apparatus mounting section, audio data recorded in the portable terminal apparatus is outputted to the speaker apparatus. The outputted audio data is outputted as sound, which is improved in sound quality and so forth, to the outside by a speaker unit.

In the speaker apparatus disclosed in Patent Document 1, a holding case ("door" in Patent Document 1) having a connector is provided at the apparatus mounting section such that it can be drawn out from an accommodating recessed portion. The portable terminal apparatus is inserted into the holding case drawn out from the accommodating recessed portion and a connector section is connected to the connector. Then, the holding case is accommodated into the accommodating recessed portion to mount the portable terminal apparatus on the apparatus mounting section.

SUMMARY

However, in the speaker apparatus disclosed in Patent Document 1, the connector section is connected to the connector in a state in which the portable terminal apparatus is inserted in the holding case. At this time, for example, when an operation is carried out for the portable terminal apparatus in a state in which it is inserted in the holding case, if force acting in which the connector section is removed from the connector is applied, then there is the possibility that the connection state of the connector section to the connector may become unstable.

Further, while a portable terminal apparatus is mounted, the state of the speaker apparatus on which the portable terminal apparatus is sometimes changed, for example, from a vertically placed state to a horizontally placed state. Thereupon, the posture of the portable terminal apparatus is changed. Also in this instance, there is the possibility that the connection state of the connector section to the connector may become unstable.

Therefore, it is desirable to overcome the problems described above and make it possible for a speaker apparatus to hold a portable terminal apparatus in a stable state.

According to the present technology, there is provided a speaker apparatus including a housing having a speaker disposition section in which a speaker unit is disposed and an apparatus receiving section which receives a portable terminal apparatus mounted thereon, a connector provided on the apparatus receiving section such that a connector section of the portable terminal apparatus is to be connected to the connector, a holder provided on the apparatus receiving section and supported for pivotal motion on the housing in such a manner as to be pivoted, in a state in which the portable terminal apparatus is connected to the connector, in a first direction to press down the portable terminal apparatus from the opposite side to the connector to hold the portable terminal apparatus, and a biasing spring provided on the apparatus receiving section and configured to bias the holder in the first direction.

In the speaker apparatus, the portable terminal apparatus is pressed down and held by the holder biased by the biasing spring from the opposite side to the connector.

With the speaker apparatus, the connection state of the connector section to the connector is not placed into an unstable state, and therefore, the portable terminal apparatus can be held in a stable state.

Preferably, the holder has a pressing down portion provided thereon in such a manner as to be pressed against the portable terminal apparatus by the biasing force of the biasing spring irrespective of a difference in size of the portable terminal apparatus.

In the speaker apparatus, the pressing down portion which is pressed against the portable terminal apparatus by the biasing force of the biasing spring irrespective of a difference in size of the portable terminal apparatus is provided on the holder. Therefore, any of portable terminal apparatus which are different in size from each other can be pressed down by the pressing down portion.

With the speaker apparatus, portable terminal apparatus having different sizes from each other can be held in a stable state by the holder.

More preferably, the face of the pressing down portion which is pressed against the portable terminal apparatus is formed as a recessed and curved face.

In the speaker apparatus, since the face of the pressing down portion which is pressed against the portable terminal apparatus is formed as a recessed and curved face, upon mounting of the portable terminal apparatus on the apparatus receiving section, the portable terminal apparatus is slidably moved along the shape of the pressing down face.

With the speaker apparatus, the portable terminal apparatus can be held in a predetermined posture in a stable state by the holder.

Preferably, the pressing down section is formed from a rubber material.

In the speaker apparatus, since the pressing down section is formed from a rubber material, when the pressing down section is contacted by the portable terminal apparatus, the impact applied to the portable terminal apparatus from the holder is absorbed by the pressing down section.

With the speaker apparatus, since, when the pressing down section is contacted by the portable terminal apparatus, the impact applied to the portable terminal apparatus from the holder is absorbed by the pressing down section, otherwise possible damage to the portable terminal apparatus can be prevented.

Preferably, the connector is mounted for pivotal motion in a direction same as the direction of pivotal motion of the holder.

In the speaker apparatus, since the connector is mounted for pivotal motion in a direction same as the direction of pivotal motion of the holder, when the portable terminal apparatus is pressed down by the pressing down portion, the connector is pivoted.

With the speaker apparatus, since, when the portable terminal apparatus is pressed down by the pressing down portion, the connector can be pivoted, the load upon the portable terminal apparatus in the state in which it is held by the holder can be reduced.

Preferably, the housing is formed in such a shape that dimensions in a vertical direction and a horizontal direction thereof are different from each other, and the speaker apparatus can be set to a vertically placed state in which the speaker apparatus is placed in a vertically elongated state with respect to the receiving face and a horizontally placed state in which the speaker apparatus is placed in a horizontally elongated state with respect to the receiving face.

In the speaker apparatus, the housing is formed in such a shape that the dimensions in the vertical direction and the horizontal direction thereof are different from each other, and the speaker apparatus can be set to a vertically placed state in which the speaker apparatus is placed in a vertically elongated state with respect to the receiving face and a horizontally placed state in which the speaker apparatus is placed in a horizontally elongated state with respect to the receiving face. Therefore, the user can use the speaker apparatus in a required direction.

With the speaker apparatus, since the user can use the speaker apparatus in a required direction, improvement in convenience in use of the speaker apparatus can be anticipated.

Preferably, the speaker apparatus further includes a locking section configured to lock the holder at an end of pivotal motion in a second direction opposite to the first direction.

In the speaker apparatus, since the locking section configured to lock the holder at the end of pivotal motion in the second direction opposite to the first direction is provided, upon connection operation of the portable terminal apparatus to the connector, the portable terminal apparatus does not interfere with the holder.

With the speaker apparatus, since, upon connection operation of the portable terminal apparatus to the connector, the portable terminal apparatus does not interfere with the holder, connection of the portable terminal apparatus to the connector can be carried out smoothly.

Preferably, an accommodation recess in which the holder is accommodated at the end of pivotal motion in the second direction is formed on the apparatus mounting section.

In the speaker apparatus, since the accommodation recess in which the holder is accommodated at the end of pivotal motion in the second direction is formed on the apparatus mounting section, upon connection operation of the portable terminal apparatus to the connector, the portable terminal apparatus does not interfere with the holder.

With the speaker apparatus, since, upon connection operation of the portable terminal apparatus to the connector, the portable terminal apparatus does not interfere with the holder, connection of the portable terminal apparatus to the connector can be carried out more smoothly.

Preferably, the speaker apparatus further includes a pivotal motion restriction section configured to restrict the pivotal motion of the holder in the first direction.

In the speaker apparatus, since the pivotal motion restriction section configured to restrict the pivotal motion of the holder in the first direction is provided, unnecessary pivotal motion of the holder in the first direction is restricted by the pivotal motion restriction section.

With the speaker apparatus, since unnecessary pivotal motion of the holder in the first direction is restricted by the pivotal motion restriction section, contact of the holder with the connector can be prevented and otherwise possible damage to the holder and the connector can be prevented.

Preferably, an insertion recess in and on which the portable terminal apparatus is inserted and mounted is formed on the apparatus receiving section, and the portable terminal apparatus is held on the holder in a state in which the portable terminal apparatus is inserted in the insertion recess.

In the speaker apparatus, since the insertion recess in and on which the portable terminal apparatus is inserted and mounted is formed on the apparatus receiving section and the portable terminal apparatus is held on the holder in a state in which the portable terminal apparatus is inserted, the portable terminal apparatus mounted on the apparatus receiving section does not project from the apparatus receiving section.

With the speaker apparatus, since the portable terminal apparatus mounted on the apparatus receiving section does not project from the apparatus receiving section, the portable terminal apparatus can be protected.

Preferably, the speaker apparatus further includes a damper configured to control the speed of pivotal motion of the holder.

In the speaker apparatus, since the damper configured to control the speed of pivotal motion of the holder is provided, when the pressing down section is contacted by the portable terminal apparatus, the impact applied to the portable terminal apparatus from the holder is reduced.

With the speaker apparatus, since, when the pressing down section is contacted by the portable terminal apparatus, the impact applied to the portable terminal apparatus from the holder is reduced, otherwise possible damage to the portable terminal apparatus can be prevented.

The above and other features and advantages of the present technology will become apparent from the following description and the appended claims, taken in conjunction with the accompanying drawings in which like parts or elements denoted by like reference symbols.

DETAILED DESCRIPTION OF THE PREFERRED EMBODIMENT

In the following, a speaker apparatus according to a preferred embodiment of the present technology is described with reference to the accompanying drawings.

In the embodiment described below, the present technology is applied to a speaker apparatus on which a digital music player (DMP) is mounted and which outputs sound of the DMP mounted thereon.

However, the technical scope of the present technology is not limited to a speaker apparatus which outputs sound of a digital music player, but the present technology can be applied widely to various speaker apparatus having a connector to which various portable terminal apparatus such as a portable telephone set having a connector section are connectable.

In the following description, directions such as upward, downward, forward, backward, leftward and rightward directions are represented with reference to a forward direction which is defined as a direction in which a speaker unit of the speaker apparatus is directed, namely, a direction in which sound is outputted.

It is to be noted that the upward, downward, forward, backward, leftward and rightward directions in the following description are represented for the convenience of description and the present technology is applied without being restricted by the directions.

(Configuration of the Speaker Apparatus)

Figure 1:
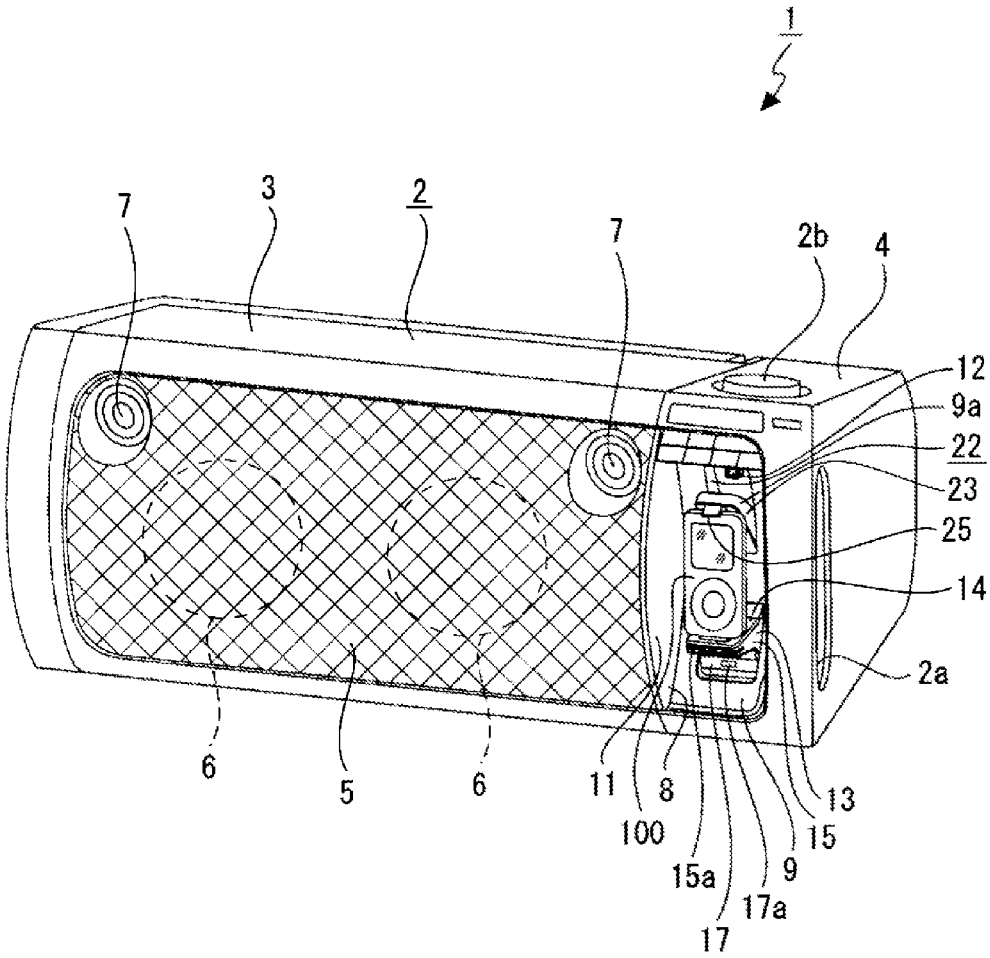
FIG. 1 shows an embodiment of the present technology together with FIGS. 2 to 15 and is a perspective view of a speaker apparatus according to the embodiment when the speaker apparatus is in a horizontally placed state.
Figure 2:
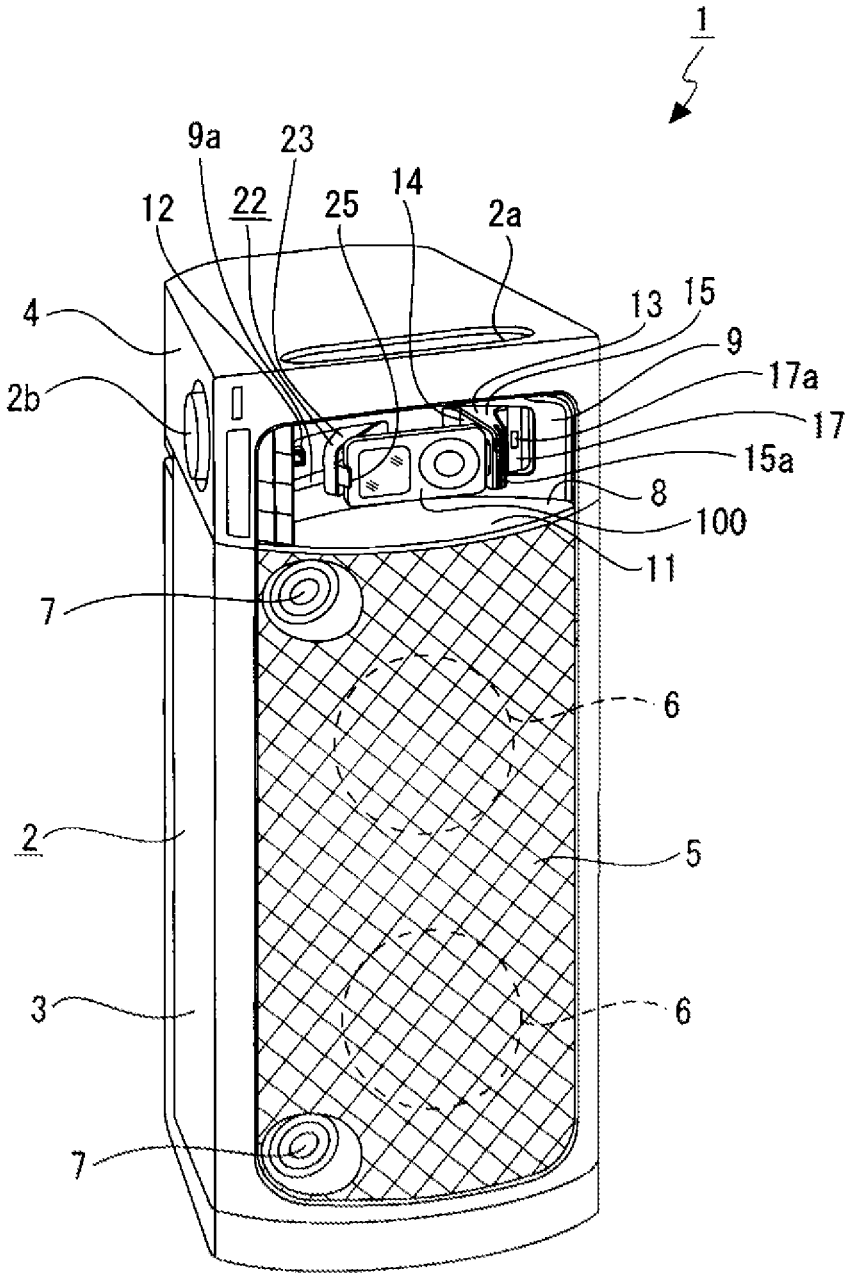
FIG. 2 is a perspective view of the speaker apparatus when it is in a vertically placed state.

Referring first to FIGS. 1 and 2, a speaker apparatus 1 shown includes various components disposed on the outer side and the inner side of a housing 2. The housing 2 is formed as a case elongated in one direction.

The speaker apparatus 1 can be used basically in a horizontally placed state and a vertically placed state. In the horizontally placed state, the speaker apparatus 1 is disposed in a horizontally elongated state on a receiving face or the like of a desk or a table as shown in FIG. 1. In the vertically placed state, the speaker apparatus 1 is disposed in a vertically elongated state on a receiving face as seen in FIG. 2.

It is to be noted that upward, downward, leftward and rightward directions used in the following description of the configuration of the speaker apparatus 1 represent those directions when the speaker apparatus 1 is in the horizontally placed state.

A pair of handles 2*a* each in the form of a recess are formed at the opposite end faces of the housing 2 in the longitudinal direction. A user can grasp the handles 2*a* to change the direction of the speaker apparatus 1 between the vertically placed state and the horizontally placed state. Since the handles 2*a* are formed on the speaker apparatus 1 in this manner, change of the direction of the speaker apparatus 1 by the user can be carried out readily.

An operation section 2*b* is disposed on an upper face of the housing 2. The operation section 2*b* functions, for example, as a sound volume adjusting dial for adjusting the sound volume of sound to be outputted from a speaker unit hereinafter described by being rotationally operated.

A portion of the housing 2 except one of the opposite left and right end portions in the horizontally placed state of the speaker apparatus 1 is provided as a speaker disposition section 3. Meanwhile, the one of the left and right end portions of the housing 2 is provided as an apparatus mounting section 4 as seen in FIG. 1.

A grill net 5 is attached to a front face of the speaker disposition section 3, and a pair of speaker units 6 are disposed in the inside of the speaker disposition section 3 as seen in FIGS. 1 and 2. A light source not shown is disposed in the inside of the speaker disposition section 3. When illuminating light is irradiated from the light source, the inside of the speaker disposition section 3 is illuminated in a decorative fashion, and the illumination in the inside is irradiated to the outside via the grill net 5.

The speaker units 6 function, for example, as midrange units for middle frequency sound.

A pair of speaker units 7 are disposed at the opposite left and right end portions of an upper end portion of the front face of the speaker disposition section 3. The speaker units 7 function, for example, as tweeter units for high frequency sound.

Figure 3:
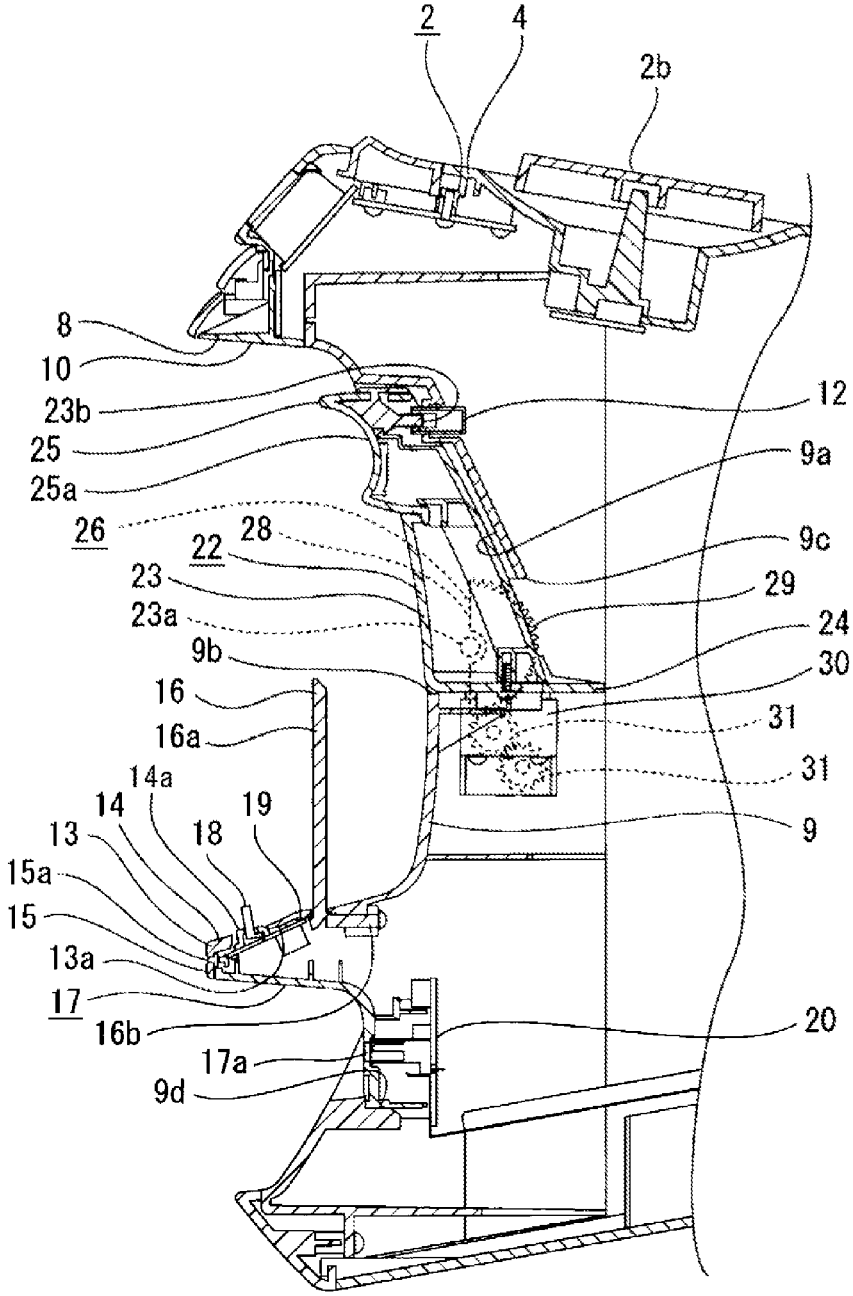
FIG. 3 is a sectional view showing an apparatus mounting section, a holder and so forth of the speaker apparatus.

The apparatus mounting section 4 has an insertion recess 8 formed therein so as to be open forwardly as seen in FIGS. 1 to 3. The insertion recess 8 is defined by an interior face portion 9 extending substantially upwardly and downwardly and formed in a curved face recessed forwardly and having a moderate curve, an upper face portion 10 projecting forwardly from an upper edge of the interior face portion 9, and side face portions 11 projecting forwardly from the opposite left and right edges of the interior face portion 9.

The interior face portion 9 is formed in a moderate curved face such that the opposite upper and lower end portions thereof are positioned a little forwardly with respect to a central portion thereof. An accommodating recess 9*a* is formed at an upper half portion of the interior face portion 9 such that it is open forwardly. An fitting hole 9*b* is formed at a lower end portion of the accommodating recess 9*a* in a communication with the inside of the housing 2. An upper side opening edge of the fitting hole 9*b* is formed as a pivotal motion restricting portion 9*c* which restricts pivotal motion of the holder hereinabove exceeding a fixed amount.

An attachment hole 9*d* is formed at a position rather near to a lower end of the interior face portion 9.

A locking portion 12 is provided at an upper end portion of the interior face portion 9. The locking portion 12 has a function of locking a holder hereinafter described to the accommodating recess 9*a*. The locking portion 12 is configured such that, for example, it locks the holder when it is pushed forwardly by the holder, but unlocks the holder by being pushed forwardly by the holder again.

A disposition projection 13 is provided at a position rather near to the lower end of the insertion recess 8 such that it projects forwardly. The disposition projection 13 has an upper wall portion 14 and a peripheral wall portion 15 continuous to an outer peripheral edge of the upper wall portion 14. An internal space thereof is formed as a disposition space 13*a*.

The upper wall portion 14 is moderately inclined forwardly downwards and has an insertion disposition hole 14*a* provided at a portion thereof rather near to a front end. A light guide plate 16 is attached to a portion of the upper wall portion 14 rather near to a rear end. The light guide plate 16 includes a light emitting portion 16*a* extending upwardly and downwardly, and an attachment object portion 16*b* projecting rearwardly from a lower end portion of the light emitting portion 16*a*. The light guide plate 16 is attached at the attachment object portion 16*b* thereof to the lower face side of the upper wall portion 14. The light emitting portion 16*a* is disposed in the insertion recess 8 such that it projects upwardly from the upper wall portion 14.

A light emitting portion 15*a* is provided on the peripheral wall portion 15 and formed transparent or translucent.

Figure 4:
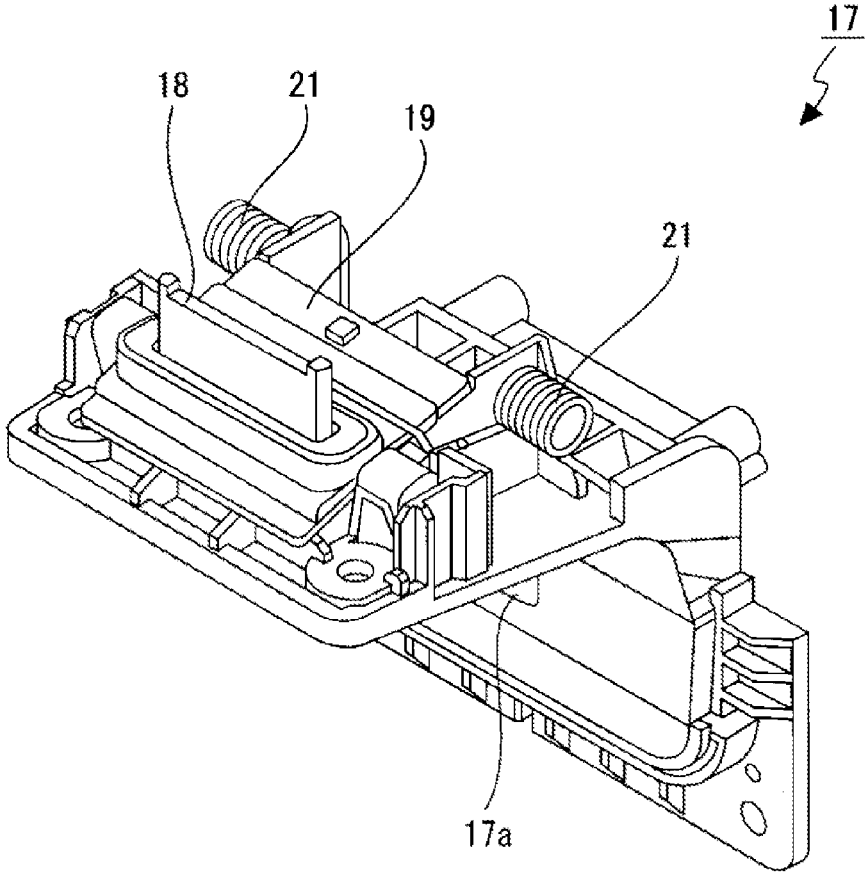
FIG. 4 is a perspective view of a connector unit of the speaker apparatus.

An connector unit 17 is attached to the interior face portion 9 such that it closes up the attachment hole 9*d* as seen in FIGS. 3 and 4. The connector unit 17 has a connector 18, a first light source circuit section 19 and a second light source circuit section 20.

The connector 18 is a male connector and is mounted for pivotal motion around a lower end portion thereof in a direction in which it moves substantially forwardly and backwardly. The connector 18 projects upwardly through the insertion disposition hole 14*a* of the upper wall portion 14. The connector 18 is attached to a circuit board of the first light source circuit section 19.

It is to be noted that, since the connector 18 is attached to the circuit board of the first light source circuit section 19, the connector 18 and the first light source circuit section 19 are pivoted integrally with each other.

The connector unit 17 has a pair of coil springs 21 provided in a leftwardly and rightwardly spaced relationship from each other thereon. The connector 18 is biased, when it is pivoted forwardly with reference to an initial position, in a direction in which it returns to the initial position by the coil springs 21. However, when the connector 18 is pivoted rearwardly with respect to the initial position, it is biased in a direction in which it returns to the initial position by the coil springs 21.

The first light source circuit section 19 has a circuit board and a light source such as a light emitting diode and is disposed along the lower face side of the upper wall portion 14. If light is emitted from the light source of the first light source circuit section 19, then the emitted light is inputted to and guided by the light guide plate 16 and then is emitted from the light emitting portion 16*a*. Further, the emitted light is inputted to the light emitting portion 15*a* of the peripheral wall portion 15 and then emitted to the outside.

The second light source circuit section 20 has a circuit board and a light source such as a light emitting diode and is disposed on the rear face side of a lower end portion of the connector unit 17. If light from the light source of the second light source circuit section 20 is emitted, then the emitted light is inputted to a light emitting portion 17*a* provided at a lower end portion of the connector unit 17 and then emitted forwardly.

Figure 5:
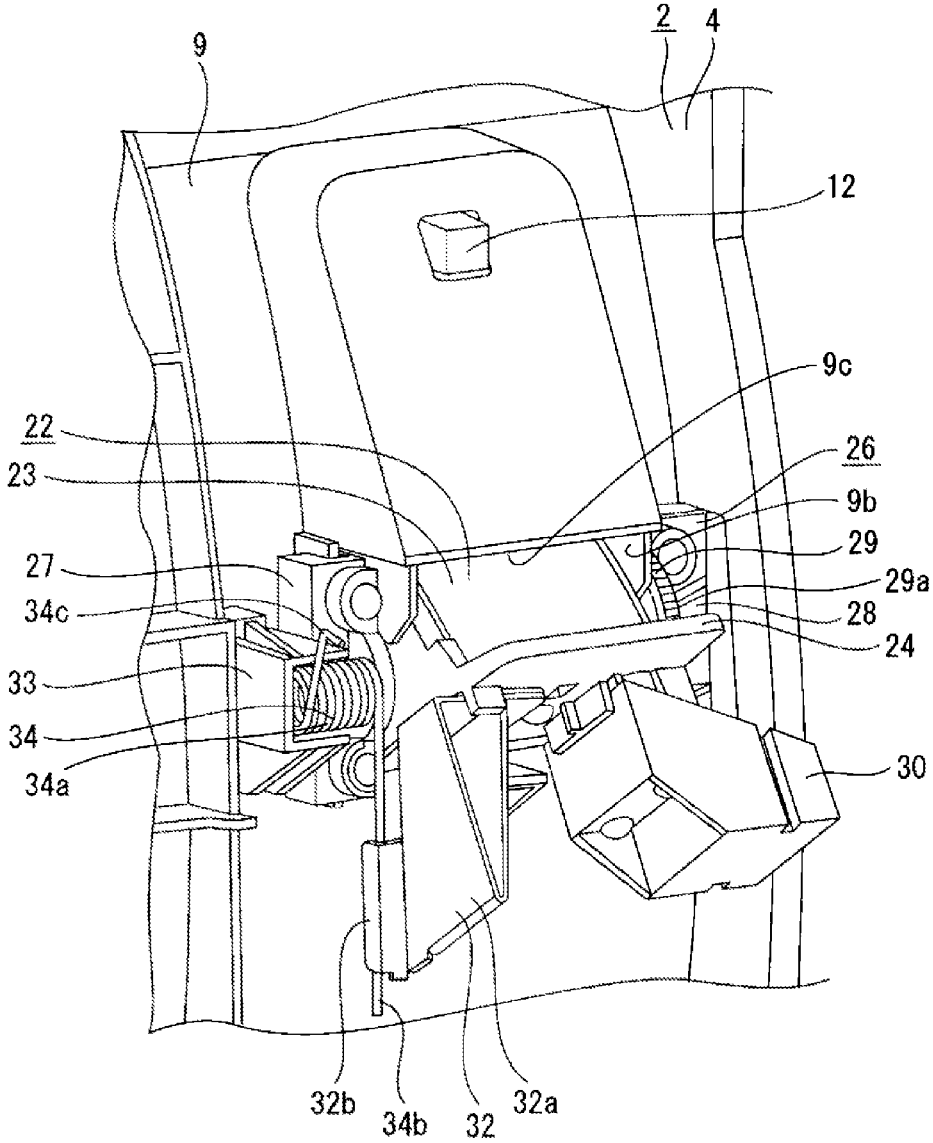
FIG. 5 is a perspective view showing the apparatus mounting section, holder and so forth.
Figure 6:
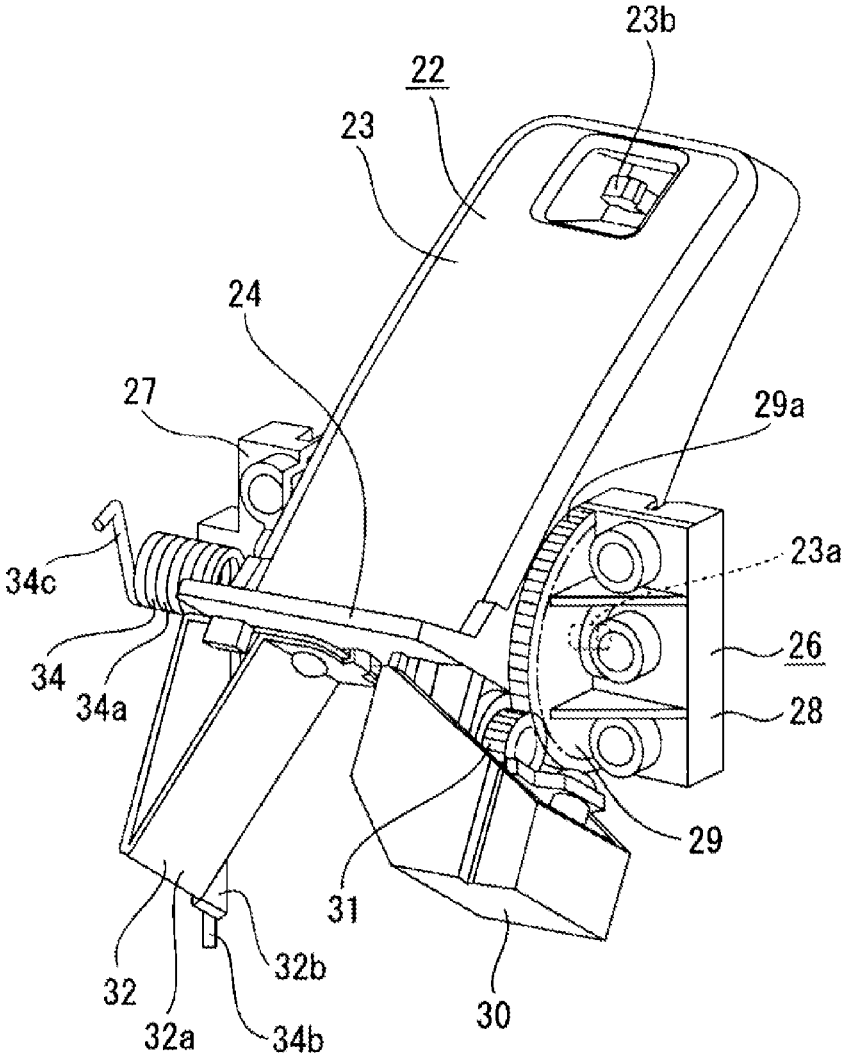
FIG. 6 is a perspective view showing the holder and so forth.
Figure 7:
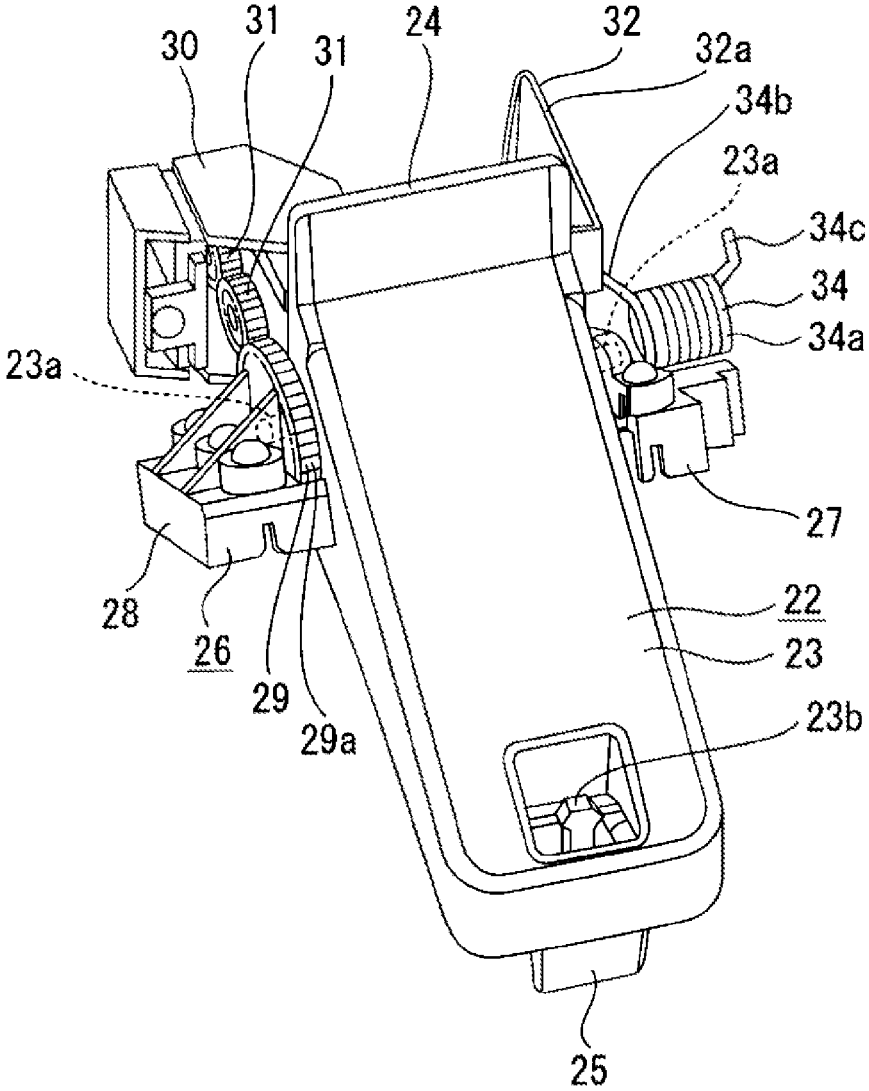
FIG. 7 is a perspective view showing the holder and so forth as viewed in a direction different from that of FIG. 6.

A holder 22 is supported pivotal motion on the apparatus mounting section 4 as seen in FIGS. 1 to 3. The holder 22 is fitted in the fitting hole 9*b* formed in the accommodating recess 9*a* of the interior face portion 9 such that a substantially upper half thereof is positioned in the insertion recess 8 while a substantially lower half thereof is positioned in the inside of the housing 2 as seen in FIG. 5.

The holder 22 is mounted for pivotal motion between an accommodated position in which it is accommodated in the accommodating recess 9*a* and a pivoted position in which it is positioned forwardly with respect to the accommodated position. The pivoted position is a pivotal motion end in a first direction, namely, in a forward direction, from between the pivoting directions of the holder 22, and the accommodated position is a pivotal motion end in a second direction, namely, in a rearward direction, from between pivoting directions of the holder 22.

The holder 22 has a main body portion 23 which extends upwardly and downwardly in the accommodated position thereof and a restriction object projection 24 projecting rearwardly from a lower end portion of the main body portion 23 as seen in FIGS. 3, 5, 6 and 7. A pair of supported shafts 23*a* are provided at a lower end portion of the opposite left and right side faces of the main body portion 23 such that they project outwardly. A locking object projection 23*b* is provided on a rear face side of an upper end portion of the main body portion 23 such that it projects rearwardly.

A pressing down portion 25 is provided on a front face of the main body portion 23 of the holder 22. The pressing down portion 25 is formed from an elastically deformable material such as a rubber material and has a front face formed as a recessed and curved face 25*a*. The curved face 25*a* is formed in a substantially semicircular shape such that an upper end and a lower end thereof are positioned on the front side with respect to an intermediate portion thereof.

A first shaft supporting member 26 and a second shaft supporting member 27 are attached in a leftwardly and rightwardly spaced relationship from each other on a rear face of the interior face portion 9 of the apparatus mounting section 4.

The first shaft supporting member 26 has a shaft supporting portion 28 and a meshing portion 29 and is attached at the shaft supporting portion 28 thereof to the interior face portion 9. A substantially semicircular supporting cutout is formed at a front end portion of the shaft supporting portion 28, and the holder 22 is inserted at one of the supported shafts 23*a* thereof in the supporting cutout so that the holder 22 is supported for pivotal motion on the first shaft supporting member 26. A substantially semicircular supporting cutout is formed also at a front end portion of the second shaft supporting member 27, and the holder 22 is inserted at the other supported shaft 23*a* thereof in the supporting cutout so that the holder 22 is supported for pivotal motion on the second shaft supporting member 27.

The meshing portion 29 of the first shaft supporting member 26 is formed in a semicircular shape projecting rearwardly and has a gear portion 29*a* on an outer circumferential face thereof.

A gear case 30 is attached to a lower face of the main body portion 23 of the holder 22. The gear case 30 is formed in a box open upwardly, and two rotational gear wheels provided as dampers 31 are disposed in a meshing state with each other in the gear case 30. One of the dampers 31 is held in meshing engagement with the gear portion 29*a* formed on the meshing portion 29 of the first shaft supporting member 26.

A spring supporting member 32 is attached to a lower face of the main body portion 23 of the holder 22. The spring supporting member 32 includes an attached face portion 32*a* attached to the main body portion 23, and a supporting projection 32*b* projecting sidewardly from the attached face portion 32*a*.

A spring case 33 is attached adjacent the second shaft supporting member 27 on a rear face of the interior face portion 9 of the apparatus mounting section 4. A biasing spring 34 is disposed in the spring case 33. For example, a torsion coil spring is used as the biasing spring 34. The biasing spring 34 is disposed and supported at a coiled portion 34*a* thereof on and by the spring case 33 and is engaged at an arm portion 34*b* with the supporting projection 32*b* of the spring supporting member 32 and at the other arm portion 34*c* with an engaging portion not shown provided on the housing 2.

Accordingly, the holder 22 is biased in the first direction from the accommodated position to the pivoted position by the biasing spring 34 through the spring supporting member 32.

When the holder 22 is pivoted around the supported shafts 23*a*, the holder 22, gear case 30 and spring supporting member 32 are pivoted integrally with each other. At this time, the dampers 31 are rotated, and one of the dampers 31 is rolled on the gear portion 29*a* and moved in a state in which it is held in meshing engagement with the gear portion 29*a* of the first shaft supporting member 26. The holder 22 is pivoted at a low speed by an action of the damper 31.

(Pivotal Motion of the Holder of the Speaker Apparatus)

In the following, a pivotal motion of the holder 22 of the speaker apparatus 1 is described with reference to FIGS. 8 to 15.

Figure 8:
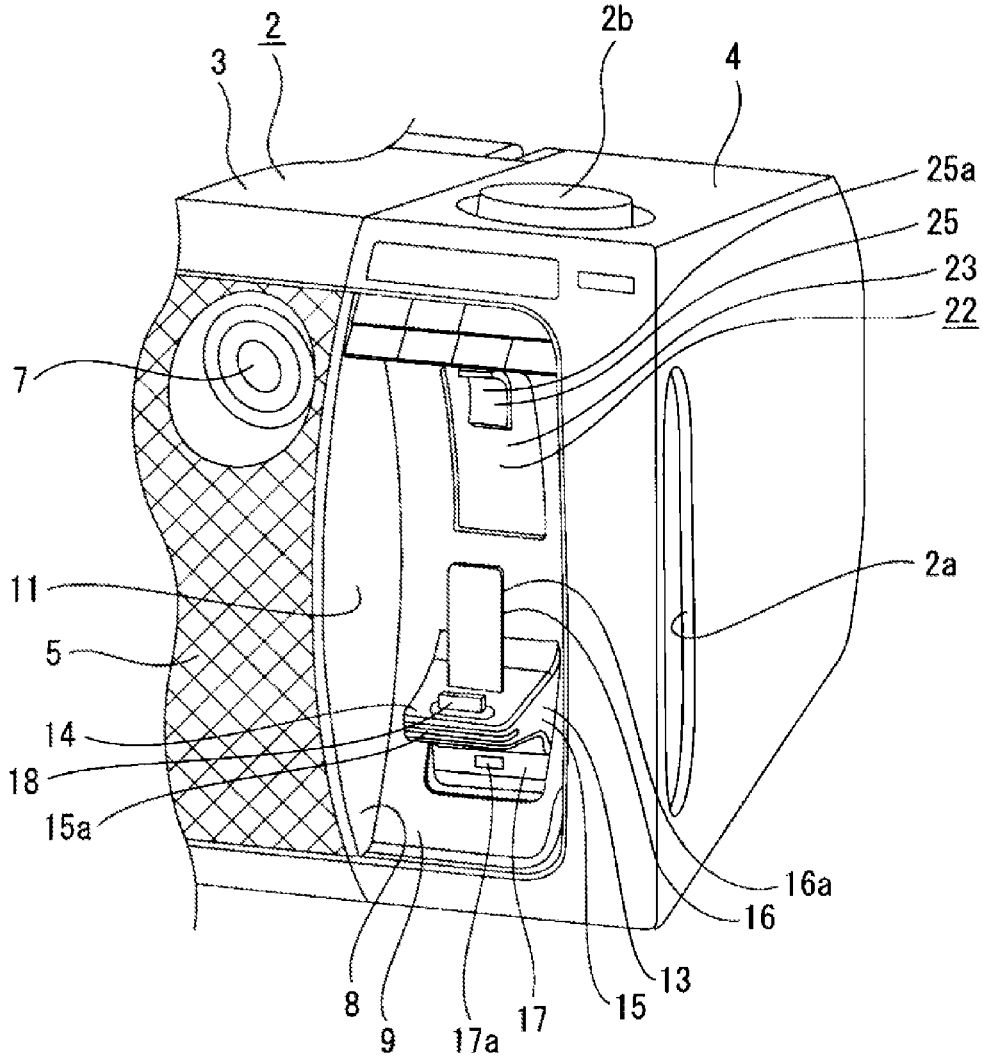
FIG. 8 is a view showing the holder in a state in which the holder is in an accommodated position and illustrating operation of the holder together with FIGS. 9 to 15.
Figure 9:
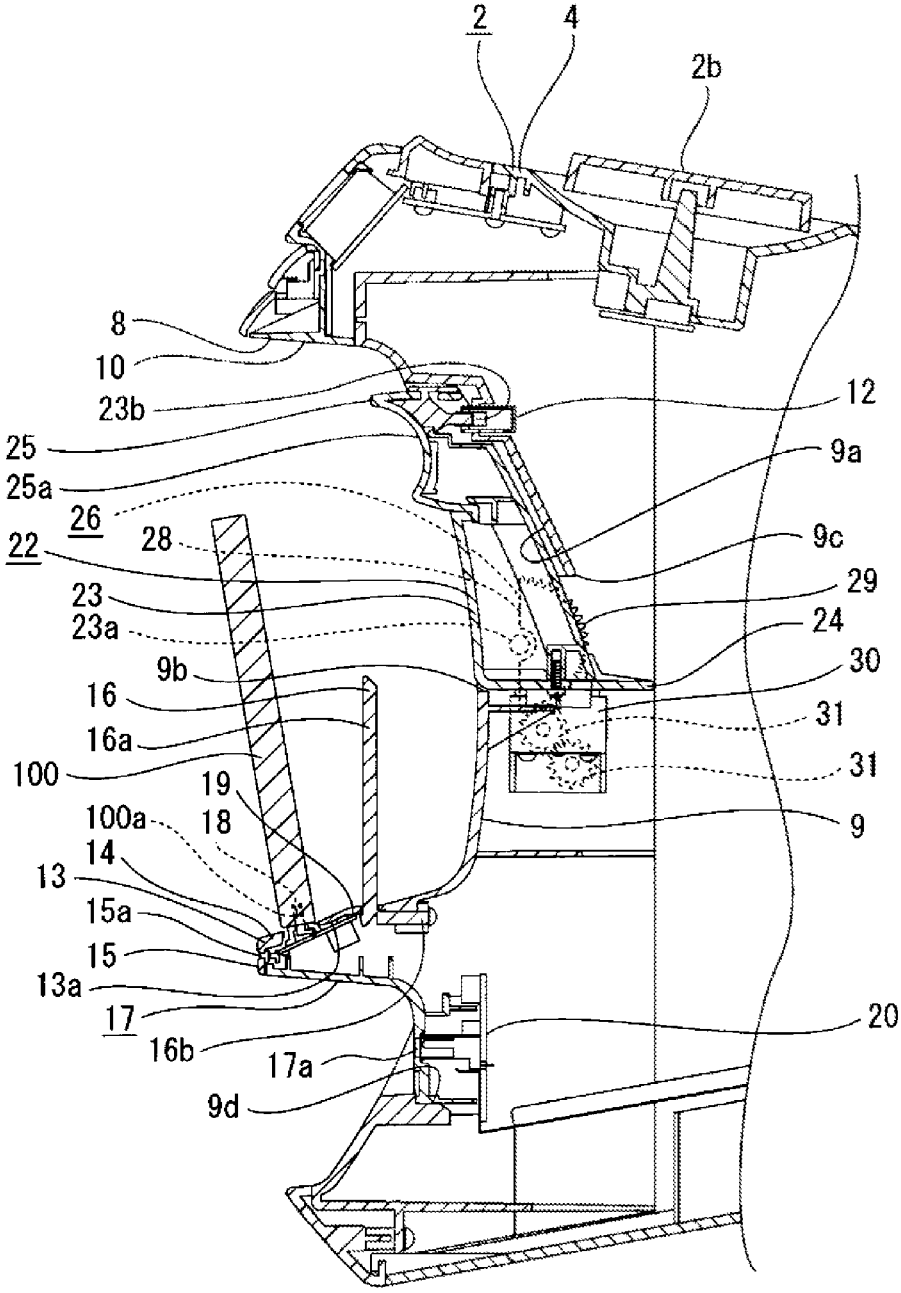
FIG. 9 is a sectional view showing the holder in the accommodated position and a portable terminal apparatus connected to a connector.

In a state in which the holder 22 is in the accommodated position in which it is accommodated in the accommodating recess 9*a* formed on the apparatus mounting section 4, the locking object projection 23*b* of the main body portion 23 is engaged with the locking portion 12 to lock the holder 22 as seen in FIGS. 8 and 9. At this time, in a state in which a portable terminal apparatus 100 is not connected to the connector 18, the connector 18 is at its initial position.

The portable terminal apparatus 100 is formed, for example, in a flattened substantially rectangular shape of a small thickness. A connector section 100*a* in the form of a female connector is provided on a lower face of the portable terminal apparatus 100.

The portable terminal apparatus 100 is inserted from obliquely upwardly into the insertion recess 8 of the apparatus mounting section 4 and connected at the connector section 100*a* thereof to the connector 18 as seen in FIG. 9.

When the portable terminal apparatus 100 is inserted into the insertion recess 8, the holder 22 is locked at the accommodated position by the locking portion 12 as described hereinabove.

Since the locking portion 12 which locks the holder 22 at the accommodated position in this manner is provided, upon a connection operation of the portable terminal apparatus 100 to the connector 18, the holder 22 does not interfere with the portable terminal apparatus 100. Further, connection of the portable terminal apparatus 100 to the connector 18 can be carried out smoothly.

Further, the accommodating recess 9*a* which accommodates the holder 22 in the accommodation position which is the pivotal motion end in the second direction is formed on the apparatus mounting section 4.

Accordingly, upon a connection operation of the portable terminal apparatus 100 to the connector 18, the holder 22 does not interference with the portable terminal apparatus 100, and connection of the portable terminal apparatus 100 to the connector 18 can be carried out more smoothly.

If the connector section 100*a* of the portable terminal apparatus 100 is connected to the connector 18, then the connector 18 is pivoted forwardly by the weight of the portable terminal apparatus 100 and the portable terminal apparatus 100 is inclined a little forwardly downwards.

Figure 10:
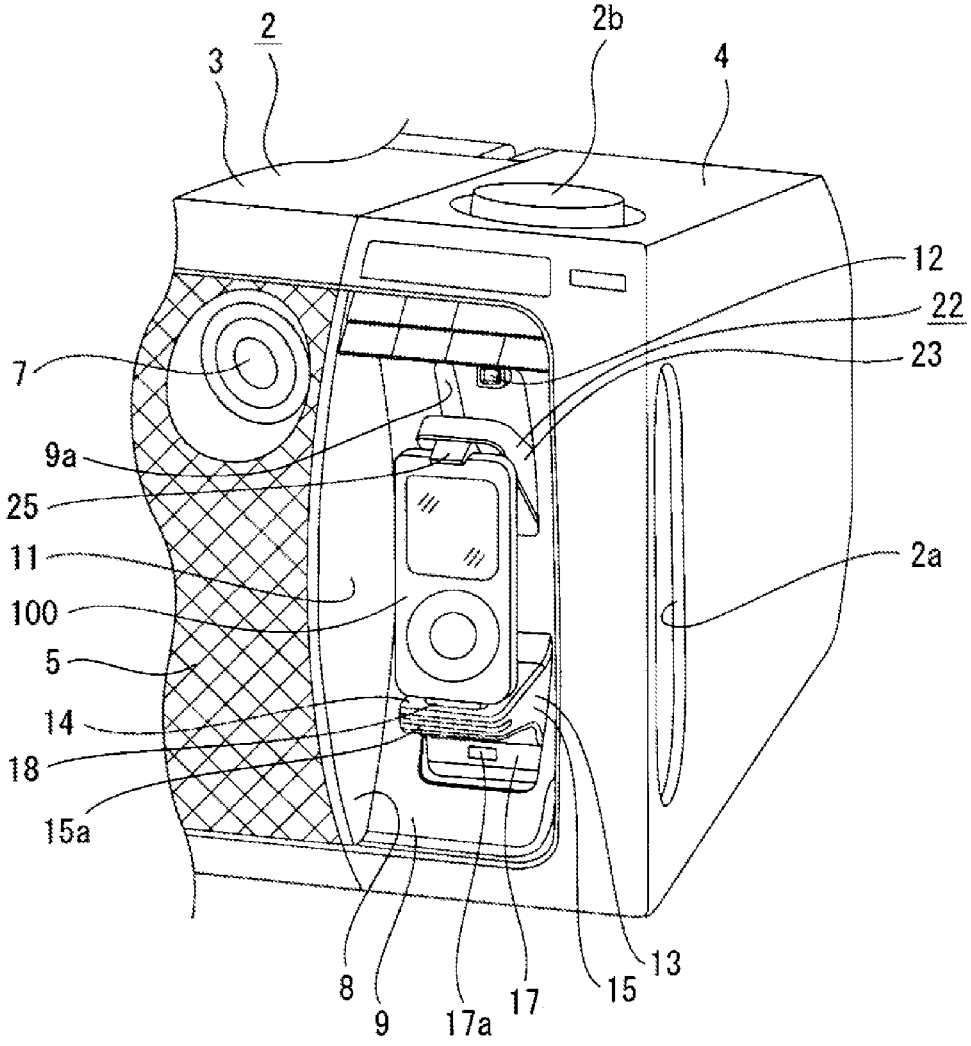
FIGS. 10 and 11 are a perspective view and a sectional view, respectively, showing the holder by which the portable terminal apparatus is held.
Figure 11:
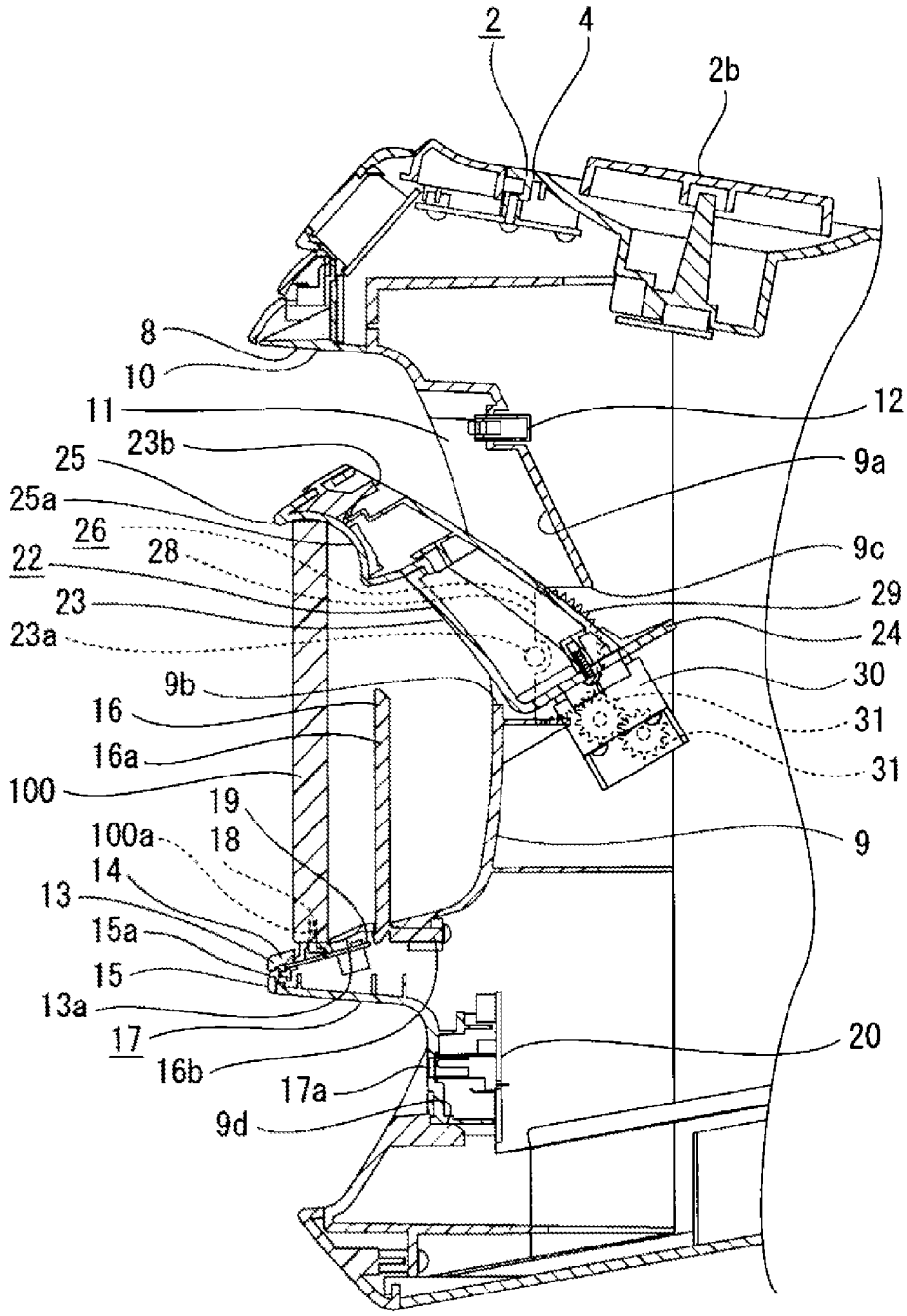

Then, if the holder 22 is pushed rearwardly by a finger, then the engagement between the locking object projection 23*b* and the locking portion 12 is canceled, and the holder 22 is pivoted in the first direction, namely, to the front side, around the supported shafts 23*a* by the biasing force of the biasing spring 34 as seen in FIGS. 10 and 11. At this time, the holder 22 is pivoted at a low speed by action of the damper 31 as described hereinabove.

When the holder 22 is pivoted in the first direction, the curved face 25*a* of the pressing down portion 25 is brought into contact with the upper face of the portable terminal apparatus 100. At this time, since the curved face 25*a* is formed in a recessed and curved face, the upper face of the portable terminal apparatus 100 is slidably moved along the shape of the curved face 25*a* and the portable terminal apparatus 100 is pivoted a little rearwardly to a predetermined position together with the connector 18. The portable terminal apparatus 100 is pushed and held from the opposite side to the connector 18 by the holder 22 until it is mounted on the apparatus mounting section 4 in a posture wherein the portable terminal apparatus 100 is directed to the front.

In this manner, in the speaker apparatus 1, since the curved face 25*a* of the pressing down portion 25 is formed in a recessed and curved face, the upper face of the portable terminal apparatus 100 is slidably moved along the shape of the curved face 25*a* and can be held in a stable state in a predetermined posture.

Further, since the connector 18 is permitted to pivot in the same direction as the direction of pivotal motion of the holder 22, when the portable terminal apparatus 100 is pressed down by the pressing down portion 25, the connector 18 is pivoted. Consequently, the load upon the portable terminal apparatus 100 in the state in which it is held by the holder 22 can be reduced.

Further, since the speaker apparatus 1 includes the dampers 31 for controlling the speed of pivotal motion of the holder 22 to a low speed, when the pressing down portion 25 is brought into contact with the portable terminal apparatus 100, the impact acting upon the portable terminal apparatus 100 from the holder 22 is low. Consequently, damage to the portable terminal apparatus 100 can be prevented.

Furthermore, since the pressing down portion 25 is formed from a rubber material, when the pressing down portion is brought into contact with the portable terminal apparatus 100, the impact acting upon the portable terminal apparatus 100 is absorbed by the pressing down portion 25. Consequently, damage to the portable terminal apparatus 100 can be prevented.

As described above, in the state in which the portable terminal apparatus 100 is mounted on the apparatus mounting section 4, the portable terminal apparatus 100 is entirely inserted into and positioned by the insertion recess 8.

Accordingly, the portable terminal apparatus 100 mounted on the apparatus mounting section 4 does not project forwardly from the apparatus mounting section 4, and consequently, the portable terminal apparatus 100 can be protected.

In the state in which the portable terminal apparatus 100 is connected by the connector 18, held by the holder 22 and mounted on the apparatus mounting section 4, for example, if an operation for music reproduction for the portable terminal apparatus 100 is carried out, then music data recorded in the portable terminal apparatus 100 is outputted as sound from the speaker units 6 and 7.

In the state in which the portable terminal apparatus 100 is mounted on the apparatus mounting section 4 as described above, the portable terminal apparatus 100 is pressed down by the holder 22 from the opposite side to the connector 18. Accordingly, also when the state of the portable terminal apparatus 100 is changed between the vertically placed state illustrated in FIG. 1 and the horizontally placed state illustrated in FIG. 2 to change the posture of the portable terminal apparatus 100, the connection state of the connector section 100*a* to the connector 18 is not placed into an unstable state.

Removal of the portable terminal apparatus 100 from the apparatus mounting section 4 can be carried out in the following manner. In particular, the holder 22 is pushed in the second direction, namely, in the rearward direction, by a finger to cancel the holding of the portable terminal apparatus 100 by the holder 22. Then, the holder 22 is pivoted to the accommodated position so as to be placed into a locked position, and the portable terminal apparatus 100 is pulled out obliquely upwardly.

When the holding of the portable terminal apparatus 100 by the holder 22 is canceled, since the connector 18 is pivoted forwardly by the weight of the portable terminal apparatus 100 and the portable terminal apparatus 100 is inclined a little forwardly downwards, pulling out of the portable terminal apparatus 100 obliquely upwards can be carried out readily.

Figure 12:
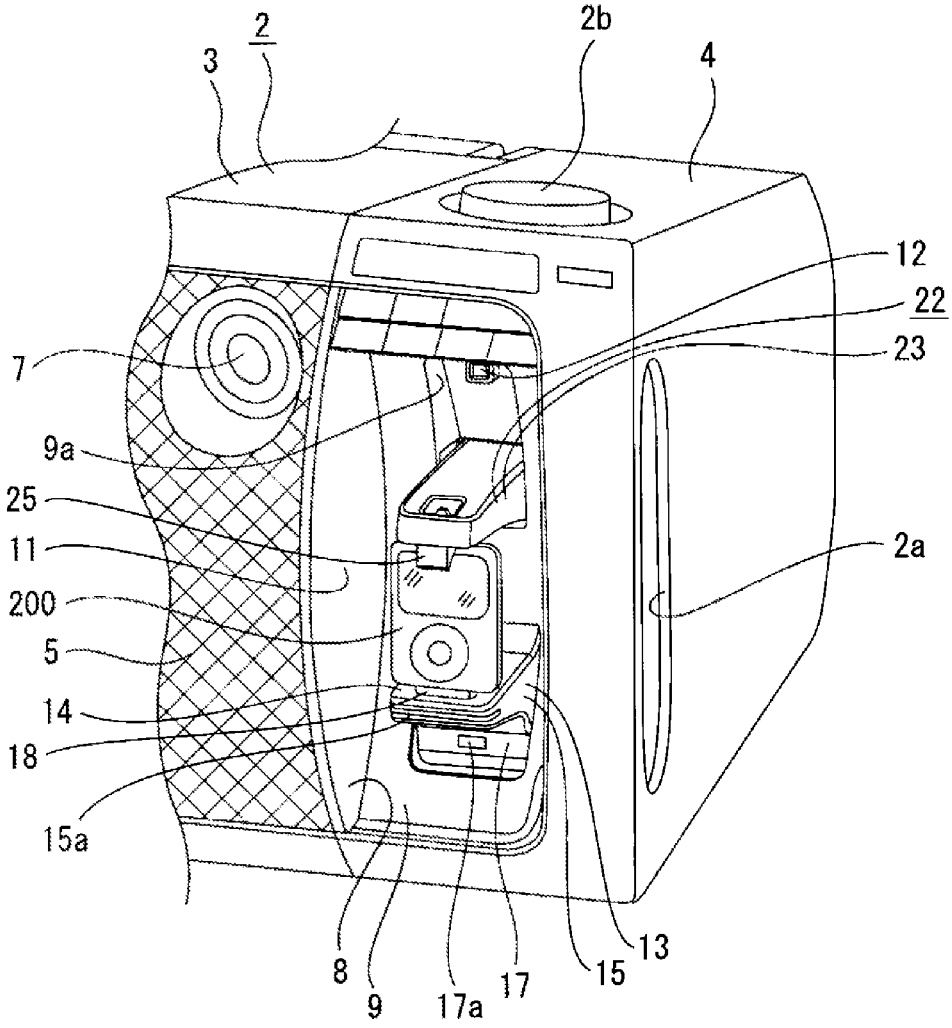
FIG. 12 is a perspective view showing the holder by which a portable terminal apparatus of a small size is held.
Figure 13:
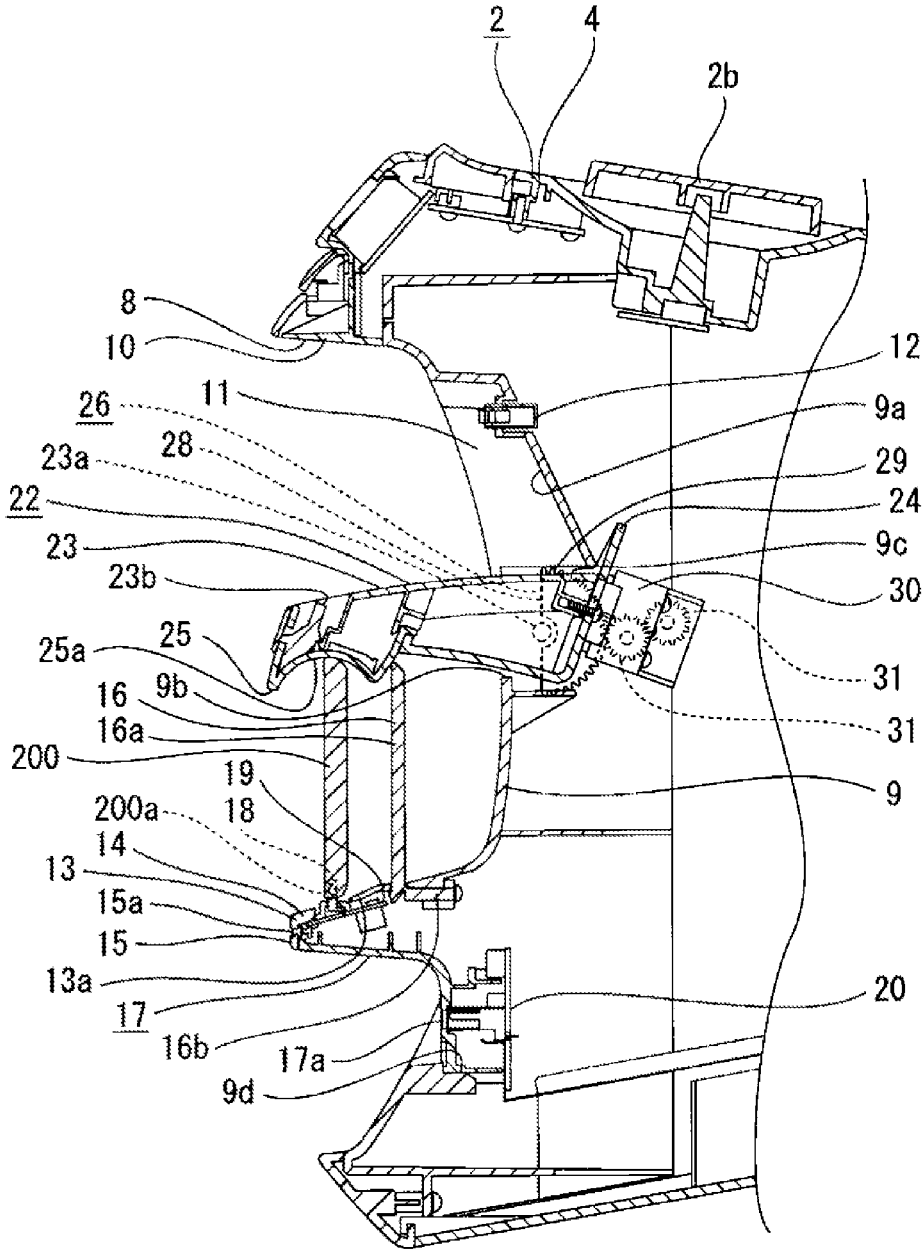
FIG. 13 is a sectional view showing the holder by which the small-sized portable terminal apparatus is held.

Now, operation when another portable terminal apparatus 200 which has a size smaller than that of the portable terminal apparatus 100 is held by the holder 22 is described with reference to FIGS. 12 and 13.

It is to be noted that, since the operation when the portable terminal apparatus 200 is held by the holder 22 is similar to that when the portable terminal apparatus 100 is held by the holder 22 except that the amount of pivotal motion of the holder 22 in the first direction is greater, the operation is described below briefly.

The portable terminal apparatus 200 is formed, for example, in a flattened, somewhat vertically elongated substantially rectangular shape of a small thickness. A connector section 200*a* in the form of a female connector is provided on a lower face of the portable terminal apparatus 200.

The portable terminal apparatus 200 is inserted from obliquely upwardly into the insertion recess 8 of the apparatus mounting section 4, and the connector section 200*a* is connected to the connector 18.

Since the connector section 200*a* of the portable terminal apparatus 200 is connected to the connector 18, the connector 18 is pivoted forwardly by the weight of the portable terminal apparatus 200, and the portable terminal apparatus 200 is inclined to a somewhat forward and downward direction.

Then, if the holder 22 is pushed rearwardly by a finger, then the engagement between the locking object projection 23*b* and the locking portion 12 is canceled, and the holder 22 is pivoted in the first direction, namely, to the front side, by the biasing force of the biasing spring 34 around the supported shafts 23*a*.

When the holder 22 is pivoted in the first direction, the curved face 25*a* of the pressing down portion 25 is placed into contact with the upper face of the portable terminal apparatus 200. The amount of pivotal motion of the holder 22 in the first direction is greater than that where the portable terminal apparatus 100 is held. At this time, since the curved face 25*a* is formed in a recessed and curved face, the upper face of the portable terminal apparatus 200 is slidably moved along the shape of the curved face 25*a* and the portable terminal apparatus 200 is pivoted rather rearwardly to the predetermined position together with the connector 18. The portable terminal apparatus 200 is held against the holder 22 from the opposite side to the connector 18 and is mounted on the apparatus mounting section 4 in a state in which it is directed to the front.

In the state in which the portable terminal apparatus 200 is mounted on the apparatus mounting section 4 as described above, the portable terminal apparatus 200 is fully inserted into and positioned in the insertion recess 8.

In the state in which the portable terminal apparatus 200 is held against the holder 22, connected to the connector 18 and mounted on the apparatus mounting section 4, for example, if an operation for music reproduction is carried out for the portable terminal apparatus 200, then music data recorded in the portable terminal apparatus 200 is outputted as sound from the speaker units 6 and 7.

In the state in which the portable terminal apparatus 200 is mounted on the apparatus mounting section 4 as described above, the portable terminal apparatus 200 is pressed down by the holder 22 from the opposite side to the connector 18. Accordingly, also when the state of the portable terminal apparatus 200 is changed between the vertically placed state illustrated in FIG. 1 and the horizontally placed state illustrated in FIG. 2 to change the posture of the portable terminal apparatus 200, the connection state of the connector section 200*a* to the connector 18 is not placed into an unstable state.

Removal of the portable terminal apparatus 200 from the apparatus mounting section 4 can be carried out in the following manner. In particular, the holder 22 is pushed in the second direction, namely, in the rearward direction, by a finger to cancel the holding of the portable terminal apparatus 200 by the holder 22. Then, the holder 22 is pivoted to the accommodated position so as to be placed into a locked position, and the portable terminal apparatus 200 is pulled out obliquely upwardly.

When the holding of the portable terminal apparatus 200 by the holder 22 is canceled, since the connector 18 is pivoted forwardly by the weight of the portable terminal apparatus 200 and the portable terminal apparatus 200 is inclined a little forwardly downwards, pulling out of the portable terminal apparatus 200 obliquely upwards can be carried out readily.

Figure 14:
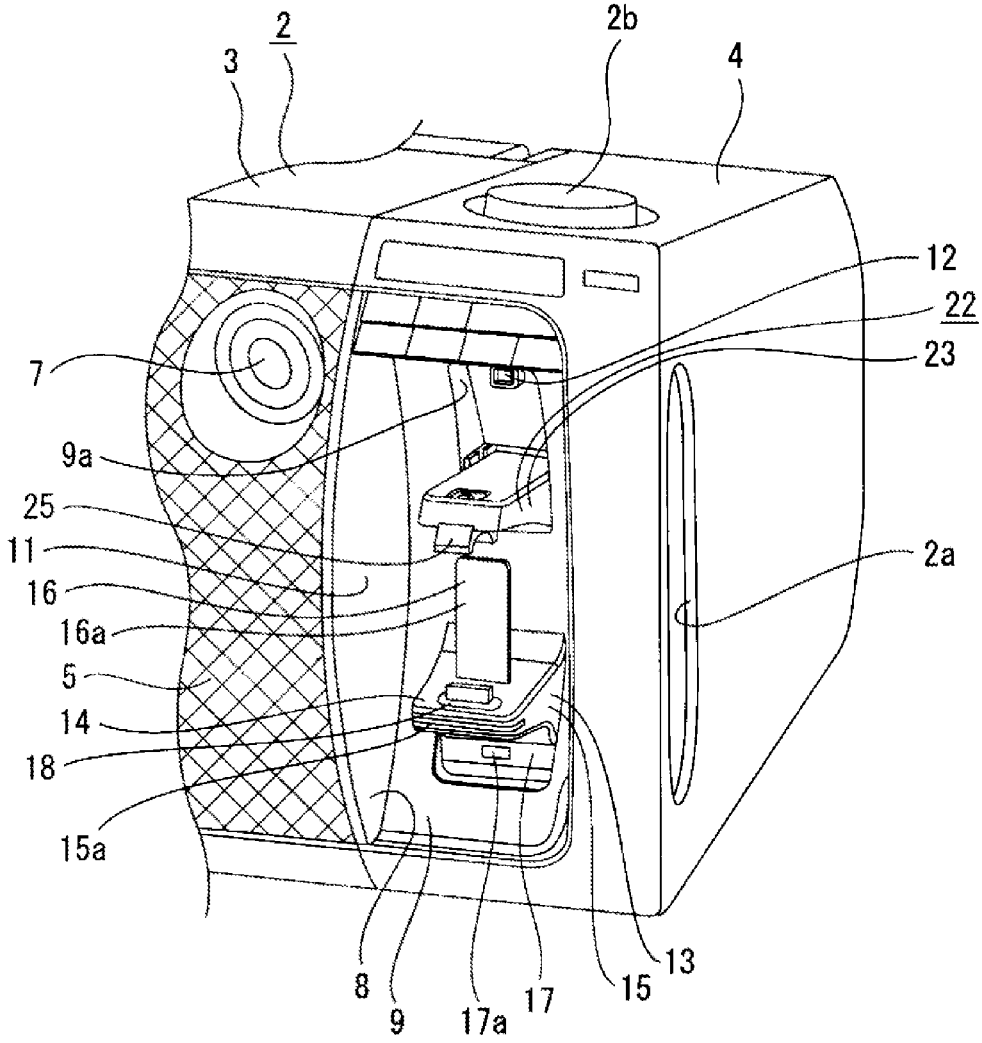
FIGS. 14 and 15 are a perspective view and a sectional view, respectively, showing the holder in a state in which it is pivoted when a portable terminal apparatus is not connected to the connector.
Figure 15:
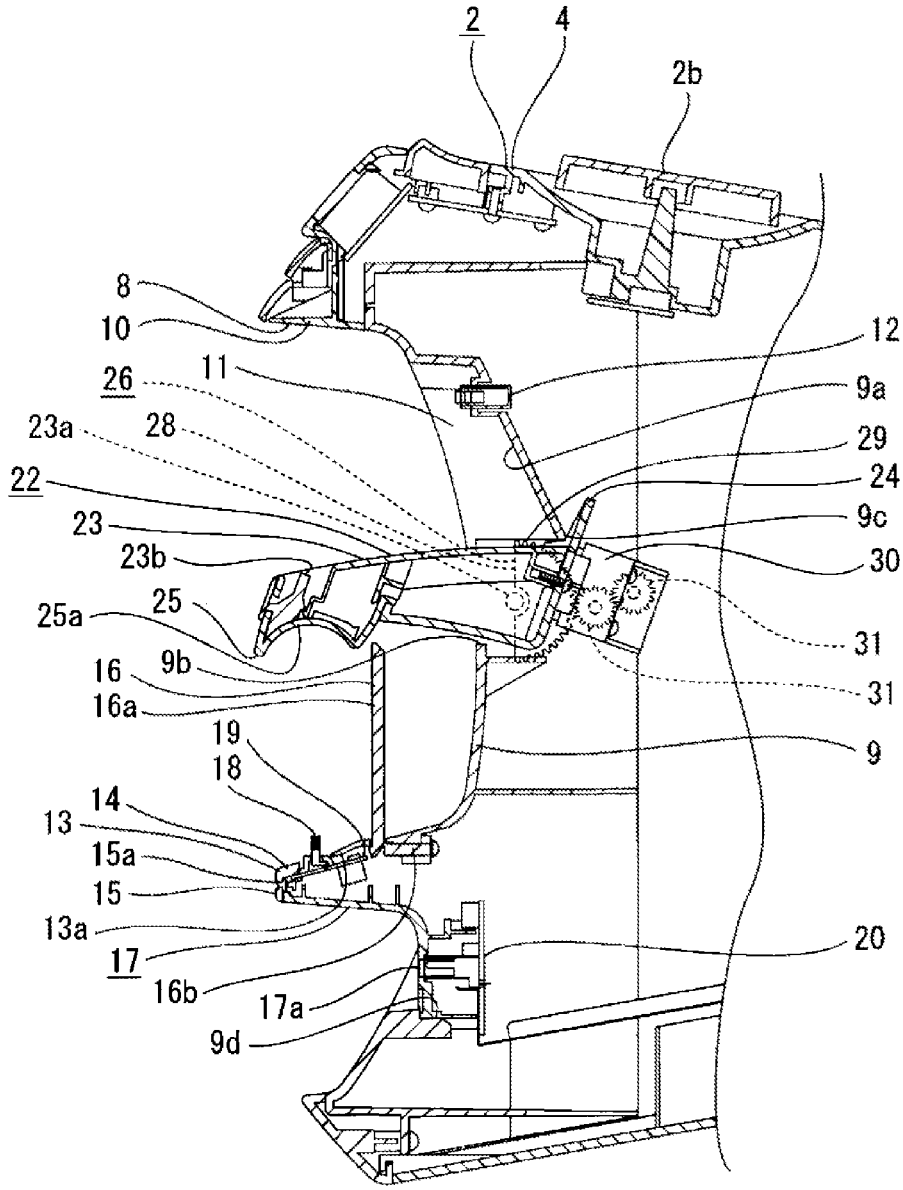

It is to be noted that, in a state in which none of the portable terminal apparatus 100 and the portable terminal apparatus 200 is connected to the connector 18, the holder 22 may possibly be pivoted in the first direction (refer to FIG. 14). In this instance, the restriction object projection 24 provided on the holder 22 is brought into contact with the pivotal motion restricting portion 9*c* of the interior face portion 9 to stop the holder 22 at a predetermined position as seen in FIG. 15.

Accordingly, unnecessary pivotal motion of the holder 22 in the first direction is restricted by the pivotal motion restricting portion 9*c*. Consequently, contact of the holder 22 with the light guide plate 16 or the connector 18 can be prevented and damage to the holder 22, light guide plate 16 or connector 18 can be prevented.

SUMMARY

As described above, the speaker apparatus 1 includes the connector 18 to which the portable terminal apparatus 100 or 200 is to be connected, holder 22 for being pivoted to press down the portable terminal apparatus 100 or 200 from the opposite side to the connector 18, and biasing spring 34 for biasing the holder 22 in the first direction.

Accordingly, also when an operation is carried out for the portable terminal apparatus 100 or 200 mounted on the apparatus mounting section 4 or when the state of the speaker apparatus 1 is changed between the vertically placed state and the horizontally placed state, the connection state of the connector section 100*a* or 200*a* to the connector 18 is not placed into an unstable state. Consequently, the portable terminal apparatus 100 or 200 can be held in a stable state.

Further, since the pressing down portion 25 which is pressed against the portable terminal apparatus 100 or 200 by the biasing force of the biasing spring 34 is provided on the holder 22, any of the portable terminal apparatus 100 and 200 which are different in size from each other can be held in a stable state by the holder 22.

Further, the speaker apparatus 1 can be set to any of the vertically placed state in which it is placed in a vertically elongated state on a receiving face and the horizontally placed state in which it is placed in a horizontally elongated state on a receiving face. Therefore, the user can use the speaker apparatus 1 in a desired direction, and improvement in convenience in use of the speaker apparatus 1 can be anticipated.

(Present Technology)

The present technology can be configured in the following manner.

(1) A speaker apparatus including a housing having a speaker disposition section in which a speaker unit is disposed and an apparatus receiving section which receives a portable terminal apparatus mounted thereon, a connector provided on the apparatus receiving section such that a connector section of the portable terminal apparatus is to be connected to the connector, a holder provided on the apparatus receiving section and supported for pivotal motion on the housing in such a manner as to be pivoted, in a state in which the portable terminal apparatus is connected to the connector, in a first direction to press down the portable terminal apparatus from the opposite side to the connector to hold the portable terminal apparatus, and a biasing spring provided on the apparatus receiving section and configured to bias the holder in the first direction.

(2) The speaker apparatus according (1) above, wherein the holder has a pressing down portion provided thereon in such a manner as to be pressed against the portable terminal apparatus by the biasing force of the biasing spring irrespective of a difference in size of the portable terminal apparatus.

(3) The speaker apparatus according to (1) or (2) above, wherein the face of the pressing down portion which is pressed against the portable terminal apparatus is formed as a recessed and curved face.

(4) The speaker apparatus according to any one of (1) to (3) above, wherein the connector is mounted for pivotal motion in a direction same as the direction of pivotal motion of the holder.

(5) The speaker apparatus according to any one of (1) to (4) above, wherein the housing is formed in such a shape that dimensions in a vertical direction and a horizontal direction thereof are different from each other, and the speaker apparatus can be set to a vertically placed state in which the speaker apparatus is placed in a vertically elongated state with respect to the receiving face and a horizontally placed state in which the speaker apparatus is placed in a horizontally elongated state with respect to the receiving face.

(6) The speaker apparatus according to any one of (1) to (5) above, further including a locking section configured to lock the holder at an end of pivotal motion in a second direction opposite to the first direction.

(7) The speaker apparatus according to (6) above, wherein an accommodation recess in which the holder is accommodated at the end of pivotal motion in the second direction is formed on the apparatus mounting section.

(8) The speaker apparatus according to any one of (1) to (7) above, further including a pivotal motion restriction section configured to restrict the pivotal motion of the holder in the first direction.

(9) The speaker apparatus according to any one of (1) to (8) above, wherein an insertion recess in and on which the portable terminal apparatus is inserted and mounted is formed on the apparatus receiving section, and the portable terminal apparatus is held on the holder in a state in which the portable terminal apparatus is inserted in the insertion recess.

(10) The speaker apparatus according to any one of (1) to (9) above, further including a damper configured to control the speed of pivotal motion of the holder.

(11) The speaker apparatus according to any one of (2) to (10) above, wherein the pressing down section is formed from a rubber material.

The particular shapes and structures of the various components specified in the description of the embodiment described hereinabove are mere examples in embodying the present technology, and the technical scope of the present technology shall not be interpreted restrictively based on them.

What is claimed is:

1. A speaker apparatus, comprising:

a housing having a speaker disposition section in which a speaker unit is disposed, and an apparatus receiving section which receives a portable terminal apparatus mounted thereon, the apparatus receiving section comprising:

a connector configured to be connected to a connector section of the portable terminal apparatus;

a holder supported for pivotal motion on the housing in such a manner as to be pivoted, in a first direction to press down the portable terminal apparatus to hold the portable terminal apparatus; and a biasing spring configured to bias the holder in the first direction, wherein the holder has a pressing down portion to press down the portable terminal apparatus from an opposite side of the connector by a biasing force of the biasing spring, and hold the portable terminal apparatus in a state in which the portable terminal apparatus is connected to the connector.

2. The speaker apparatus according to claim 1, wherein the pressing down portion presses down another portable terminal apparatus of a different size than a size of the portable terminal apparatus, by the biasing force of the biasing spring, and holds the another portable terminal apparatus in a state in which the another portable terminal apparatus is connected to the connector.

3. The speaker apparatus according to claim 1, wherein the pressing down portion comprises a recessed and curved face, which is pressed against the portable terminal apparatus.

4. The speaker apparatus according to claim 1, wherein the pressing down portion is formed of a rubber material.

5. The speaker apparatus according to claim 1, wherein the connector is mounted for pivotal motion in a direction same as a direction of pivotal motion of the holder.

6. The speaker apparatus according to claim 1, wherein the housing is formed in such a shape that a dimension in a vertical direction is different from a dimension in a horizontal direction, and the speaker apparatus is set to a vertically placed state and a horizontally placed state, wherein in the vertically placed state, the speaker apparatus is placed in a vertically elongated state with respect to a receiving face, and wherein in the horizontally placed state, the speaker apparatus is placed in a horizontally elongated state with respect to the receiving face, wherein the portable terminal apparatus is connected to the connector in both of the vertically placed state and the horizontally placed state.

7. The speaker apparatus according to claim 1, further comprising:

a locking section configured to lock the holder at an end of pivotal motion in a second direction opposite to the first direction.

8. The speaker apparatus according to claim 7, wherein an accommodation recess, in which the holder is accommodated at the end of pivotal motion in the second direction, is formed on the apparatus receiving section.

9. The speaker apparatus according to claim 1, further comprising:

a pivotal motion restriction section configured to restrict the pivotal motion of the holder in the first direction.

10. The speaker apparatus according to claim 1, wherein the apparatus receiving section further comprises an insertion recess in which the portable terminal apparatus is inserted and mounted, and the portable terminal apparatus is held on the holder in a state in which the portable terminal apparatus is inserted in the insertion recess.

11. The speaker apparatus according to claim 1, further comprising:

a damper configured to control a speed of pivotal motion of the holder.

* * * * *